US005292116A

United States Patent [19]

Inoue et al.

[11] Patent Number: 5,292,116

[45] Date of Patent: Mar. 8, 1994

[54] SHEET FEEDING APPARATUS

[75] Inventors: Ryukichi Inoue; Yutaka Kikuchi, both of Kawasaki; Yasuyoshi Hayakawa, Yokohama; Naoki Asano, Kawasaki; Kazuhiro Nomoto, Tokyo, all of Japan

[73] Assignee: Canon Kabushiki Kaisha, Tokyo, Japan

[21] Appl. No.: 871,549

[22] Filed: Apr. 21, 1992

[30] Foreign Application Priority Data

Apr. 22, 1991 [JP] Japan ..... 3-90752

[51] Int. Cl.[5] ..... B65H 1/26

[52] U.S. Cl. ..... 271/157; 271/164; 271/240

[58] Field of Search ..... 271/157, 164, 240

[56] References Cited

U.S. PATENT DOCUMENTS

| | | | |
|---|---|---|---|
| 3,104,873 | 9/1963 | Benson et al. | 271/171 |
| 3,672,665 | 6/1972 | Schnall et al. | 271/164 |
| 3,873,084 | 3/1975 | Ito | 271/169 |
| 4,030,725 | 6/1977 | Fukui et al. | 271/164 |
| 4,032,137 | 6/1977 | Katayama et al. | 271/164 |
| 4,060,234 | 11/1977 | Motoyama | 271/164 |
| 4,358,102 | 11/1982 | Hoshizaki et al. | 271/164 |
| 5,002,266 | 3/1991 | Kikuchi et al. | 271/3 |
| 5,026,039 | 6/1991 | Kuzuya et al. | 271/171 |

FOREIGN PATENT DOCUMENTS 54-159583 11/1979 Japan .

*Primary Examiner*—David H. Bollinger

*Attorney, Agent, or Firm*—Fitzpatrick, Cella, Harper & Scinto

[57] ABSTRACT

The present invention provides a sheet feeding apparatus having a sheet supporting tray removably mountable within the sheet feeding apparatus and adapted to stack and support sheets, a regulating device provided on the sheet supporting tray and adapted to regulate and position lateral edges of the sheets stacked in the sheet supporting tray, an urging mechanism for urging with a predetermined urging force the sheets stacked in the sheet supporting tray against the regulating device, and an urging force adjusting mechanism for adjusting the urging mechanism so that the urging mechanism can urge the sheets against the regulating device with greater force during insertion of the sheet supporting tray into the sheet feeding apparatus.

27 Claims, 15 Drawing Sheets

SHEET FEEDING APPARATUS

BACKGROUND OF THE INVENTION

1. Field of the Invention

The present invention relates to a sheet feeding apparatus which can separate sheets one by one by utilizing the friction force of the sheets stacked in a cassette and then can feed it to an image forming system.

2. Related Background Art

An example of a conventional sheet feeding apparatus of this kind is shown in FIGS. 14 and 15.

In FIGS. 14 and 15, a cassette 101 has an intermediate plate 103 on which sheets are stacked and which is pivotally supported on pivot pins 105 at its base end. Upper limit pegs 102 for limiting a stacking amount of sheets to be stacked in the cassette 101 are formed on a rear wall of the cassette at its upper end. Further, a size indicating means 104 for transmitting the size of the sheet stacked in the cassette to the sheet feeding apparatus and an image forming system is provided on an outer surface of a side wall of the cassette 101. A pair of separating pawls or claws 106 are mounted for movement in an up-and-down direction at front corners of the cassette 101, and a base portion of each separating claw is pivotally mounted on a caulking pin 116. The separating claws 106 serve to urge against front corners of the sheet stack rested on the intermediate plate 103 and to separate an uppermost sheet from the other sheets.

A support plate 110 is disposed in the vicinity of the other side wall of the cassette 101, and a pressure spring 107 is fixed to an inner surface of the support plate by a screw 109. An edge regulating member (not shown) is opposed to the pressure spring 107, which regulating member serves to regulate a position of one lateral edge (parallel to a sheet feeding direction) of the sheet stack in the cassette 101. A sheet guide 112 for guiding the sheet fed from the cassette 101 is formed on the front portion of the cassette 101. Further, the intermediate plate 103 is provided with a slot 113 for receiving a sensor for detecting the presence/absence of the sheet, and a separating sheet 115 adhered thereto and adapted to prevent the double feed of the last sheet.

However, in the above-mentioned conventional sheet feeding apparatus, since the pressure spring 107 was used to regulate the lateral edge of the sheet stack, the following drawbacks arose:

(1) If the sheet stack is obliquely rested (referred to as "oblique stack" or "skew stack" hereinafter) in the cassette 101, the skew-feed of the sheet to be fed cannot be avoided.

(2) If a spring force of the pressure spring 107 is increased to avoid the drawback as mentioned in the above Item (1), when a thin sheet stack is stored in the cassette 101 for a long time, the lateral edges of the sheet stack will be deformed, thus causing the bending of the sheets and/or the poor transfer of a toner image onto the sheet.

In order to eliminate the above drawbacks, an improved technique has been proposed, as disclosed in the Japanese Utility Model Laid-Open Appln. No. 54-159583.

According to this technique, a coil spring is arranged between a movable side plate adapted to be contacted with the lateral edge of the sheet stack and a pivotable actuator so that when the sheet stack is rested on a bottom plate, the actuator is cocked to reduce a distance between the movable side plate and the actuator, thereby urging the movable side plate toward the sheet stack by the relatively strong force of the coil spring to align the lateral edges of the sheets with each other, and, when the bottom plate is lifted to feed the sheet, the actuator returns to a laid condition to increase the distance between the movable side plate and the actuator, thereby urging the movable side plate toward the sheet stack by the relatively weak force of the coil spring. In this way, when the sheets are replenished, the lateral edges of the sheets can be aligned with each other, and, when the sheet is fed, the urging force of the movable side plate is decreased, thus preventing poor sheet supply.

However, with this arrangement, when the sheets are replenished, it is necessary to set the sheets on the bottom plate in opposition to the strong urging force of the movable side plate, thus severely degrading the operability.

Further, since the urging forces are adjusted in two-stages by the single coil spring, the values of the urging forces are determined unconditionally, with the result that effective urging forces cannot be obtained. That is to say, if the urging force for aligning the sheets with each other is set to a greater value, the urging force acting on the sheets when the sheet is being fed will also become greater, thus easily causing poor sheet supply; whereas, if the urging force acting on the sheets when the sheet is fed is set to a smaller value, the urging force for aligning the sheets with each other will also become smaller, thus causing poor alignment of the sheets.

SUMMARY OF THE INVENTION

The present invention aims to eliminate the above-mentioned drawbacks and an object of the present invention is to improve the operability during the sheet replenishing operation.

In order to achieve the above object, the present invention provides a sheet feeding apparatus comprising sheet supporting means removably mountable within the sheet feeding apparatus and adapted to stack and support sheets, regulating means provided on the sheet supporting means and adapted to regulate and position lateral edges of the sheets stacked in the sheet supporting means, urging means for urging the sheets stacked in the sheet supporting means against the regulating means, and urging force adjusting means for controlling the urging means so that the urging means can urge the sheets against the regulating means with temporarily greater force, in response to an insertion movement of the sheet supporting means into the sheet feeding apparatus.

With this arrangement, when the sheets are replenished, the urging force of the urging means is decreased to facilitate the sheet stacking operation, and, when the sheet supporting means is inserted into the sheet feeding apparatus, the urging force is temporarily increased to surely align the sheets with each other, and, when the insertion of the sheet supporting means is completed, the urging force is again decreased to prevent poor sheet supply.

Another object of the present invention is to properly set the ratio between an urging force when sheets are aligned with each other and an urging force when the sheet is supplied.

In order to achieve the above object, the present invention provides a sheet feeding apparatus comprising sheet supporting means removably mountable within the sheet feeding apparatus and adapted to stack and support sheets, regulating means provided on the sheet supporting means and adapted to regulate and position lateral edges of the sheets stacked in the sheet supporting means, a plurality of urging means for urging the sheet stacked in the sheet supporting means against the regulating means, and releasing means for selectively releasing an urging force of at least one of the plural urging means, in response to an insertion movement of the sheet supporting means into the sheet feeding apparatus.

With this arrangement, since the urging force of the urging means for always urging the sheets and the urging force of the urging means for urging the sheet to align the sheets can be set individually, it is possible to urge the sheets properly both when the sheets are aligned with each other and when the sheet is supplied.

DETAILED DESCRIPTION OF THE PREFERRED EMBODIMENTS

The present invention will now be explained in connection with embodiments thereof with reference to the accompanying drawings.

First of all, a first embodiment of the present invention will be described with reference to FIGS. 1 and 2.

Figure 1:
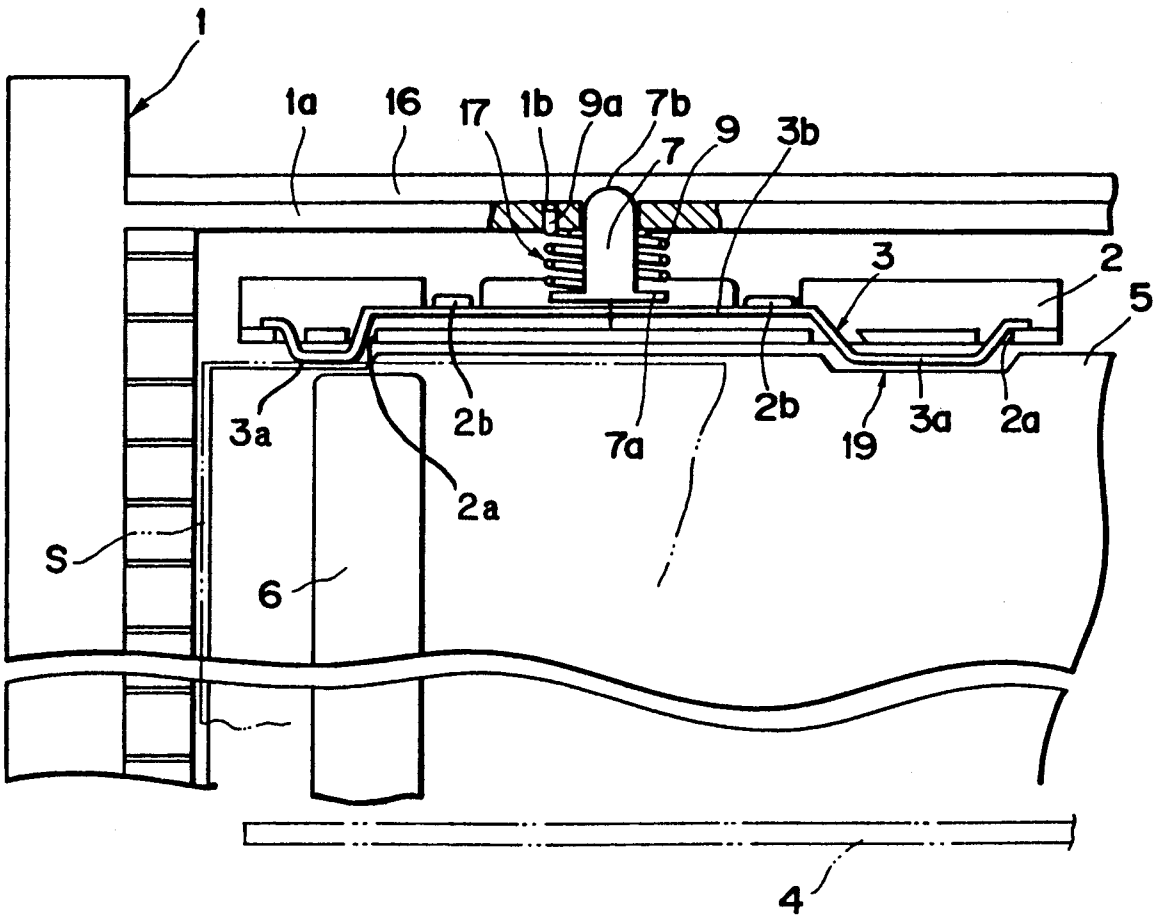
FIG. 1 is a partial plan view, in partial section, of a cassette according to a first embodiment of the present invention.
Figure 2:
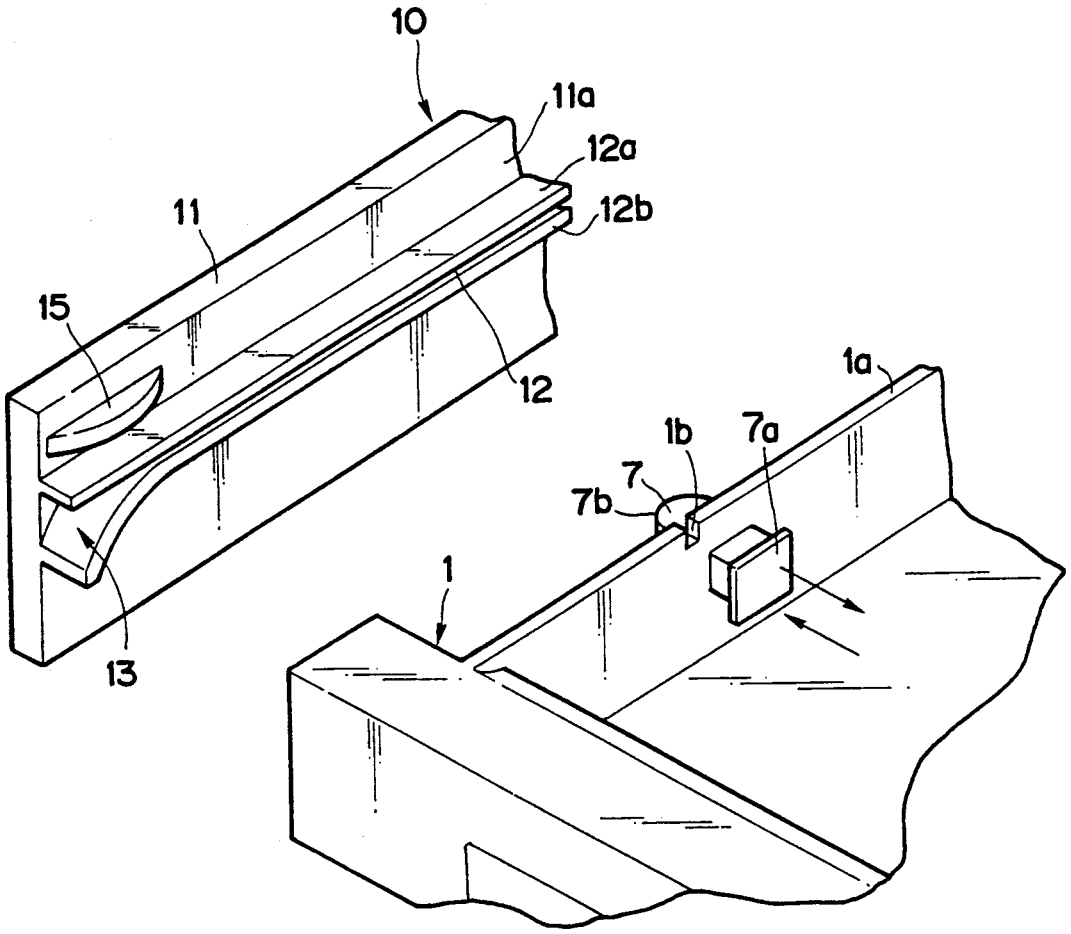
FIG. 2 is a partial perspective view showing an engagement relation between the cassette and a sheet feeding apparatus according to the first embodiment.

In FIGS. 1 and 2, a support plate 2 is fixedly mounted within a cassette 1 in the vicinity of a side wall 1*a* of the cassette. The support plate 2 and a pair of holder plates 2*b* formed thereon define an appropriate clearance or space in which a pressure plate 3 comprising a leaf spring is inserted and held. Convex pressure portions 3*a* formed on both ends of the pressure plate 3 pass through corresponding openings 2*a* formed in the support plate 2 and protrude toward the interior of the cassette 1. An intermediate plate 5 disposed within the cassette 1 has a base portion (right end in FIG. 1) pivotally supported by pivot pins (not shown). Further, a separating sheet 6 for separating a last sheet is adhered on a front portion of the intermediate plate 5 on which sheets S are to be stacked.

An urging plate 7*a* of a skew stack correcting member 7 is disposed so as to confront to an outer surface of the pressure plate 3 and is spaced apart from the latter. A free end 7*b* of the skew stack correcting member 7 passes through a hole formed in the side wall 1*a* and partially protrudes from the side wall 1*a*. Further, a skew stack correcting spring 9 arranged around the skew stack correcting member 7 has one end 9*a* engaged and locked by a lock hole 1*b* formed in the side wall 1*a* and the other end locked by the skew stack correcting member 7. The skew stack correcting spring 9 has a free length in a condition shown in FIG. 1. In the vicinity of the other side wall (not shown) opposing to the side wall 1*a*, there is arranged an edge regulating member 4 for regulating the position of the sheets S in the cassette 1. Rails 16 formed on outer surfaces of the side walls of the cassette serve to guide the cassette when the cassette 1 is mounted within a sheet feeding apparatus which will be described later.

The support plate 2, pressure plate 3 and the like constitute a pressurizing unit 19. Further, the skew stack correcting member 7, skew stack correcting spring 9 and the like constitute a biasing mechanism 17 for biasing,; the pressurizing unit 19 as will be described below.

FIG. 2 is a perspective view of the cassette 1 and the sheet feeding apparatus 10 within which the cassette is to be mounted. In order to clarify the drawings in FIG. 2, some structural elements are omitted. In FIG. 2, the sheet feeding apparatus 10 has a pair of cassette guides 11 (one of which is not shown) on which the cassette 1 is to be mounted. An upper guide 12*a* and a lower guide 12*b* defining a guide groove 12 therebetween are formed on an inner surface 11*a* of each cassette guide 11, and an enlarged inlet 13 for facilitating the insertion of the corresponding rail 16 of the cassette 1 into the guide groove is formed at a front end of each guide groove 12. Further, a semi-circular cam 15 is fixedly attached to the inner surface 11*a* of one of the cassette guides 11.

With the arrangement as mentioned above, the skew stack of the sheets S rested on the cassette 1 can be corrected as follows:

First of all, when the rails 16 of the cassette 1 within which the sheets S are stacked are inserted into the corresponding guide grooves 12 of the cassette guides 11, the free end 7*b* of the skew stack correcting member 7 of the cassette 1 is abutted against the cam 15 of the cassette guide 11, with the result that the skew stack correcting member 7 is gradually deployed into the cassette 1. The deployment of the skew stack correcting member 7 causes the urging plate 7*a* to urge pressure plate 3. As a result, the lateral edges of the sheets S stacked on the intermediate plate 5 are urged against the edge regulating member 4 with the greater force further biased by the biasing mechanism 17, thus correcting the skew stack of the large number of sheets S. As the cassette 1 is further inserted until it is completely mounted within the apparatus, the skew stack correcting member 7 is separated from the cam 15, with the result that the sheets S are subjected to the normal urging force only from the pressure plate 3.

According to the illustrated embodiment, with the arrangement as mentioned above, the following advantages can be obtained:

(1) Even when a large number of sheets are obliquely stacked in the cassette, the skew stack of the sheets can easily be corrected merely by mounting the cassette into the sheet feeding apparatus.

(2) Even when a small number of sheets are stacked in the cassette, since the sheets are merely bowed temporarily, the shrinkage in the sheets and poor sheet supply can be effectively prevented as long as the pressure plate can contact with the sheet along a relatively long length.

(3) Although the stronger force had to be applied to the sheets to correct the skew stack of the sheets when the conventional pressure plate was used, according to the illustrated embodiment, since the urging force normally applied from the pressure plate is relatively small (i.e., force for only preventing the skew feed of the uppermost sheet), the replenishment of the sheets in the cassette and the removal of the sheet from the cassette can be facilitated.

Next, a second embodiment of the present invention will be explained with reference to FIG. 3. In this second embodiment, the pressurizing unit including the pressure plate and the biasing mechanism for increasing the urging force for the correction of the skew stack of the sheets are different from those of the first embodiment, however, other arrangements are the same as those of the first embodiment.

Figure 3:
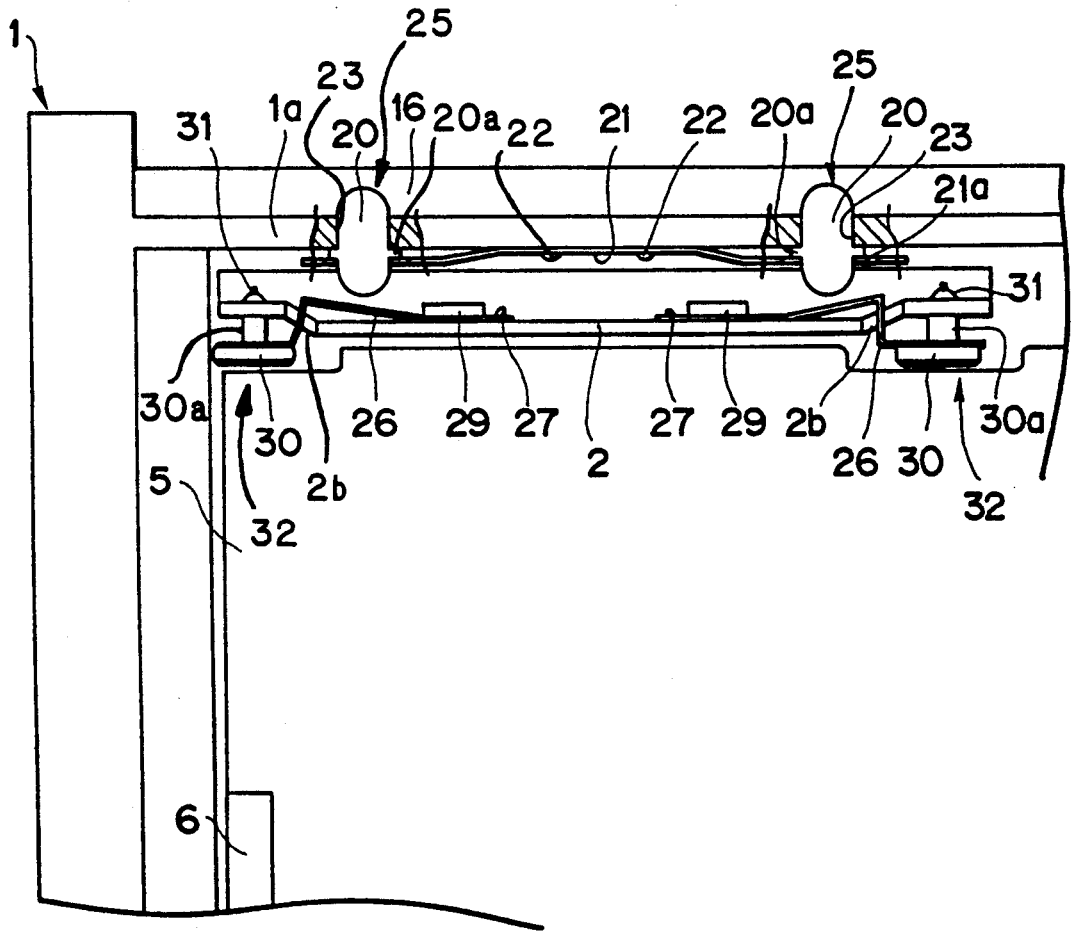
FIG. 3 is a partial plan view, in partial section, of a cassette according to a second embodiment of the present invention.

In FIG. 3, a pressure plate 21 is secured to the side wall 1*a* of the cassette by screws 22 and skew stack correcting members 20 are mounted in slots formed in both end portions of the pressure plate. Each skew stack correcting member 20 protrudes from a corresponding hole 23 formed in the side wall 1*a* and a flange 20*a* of each skew stack correcting member 20 is abutted against the side wall 1*a* by an elastic force of the pressure plate 21. The skew stack correcting members 20, pressure plate 21 and the like constitute a biasing mechanism 25.

Base portions of a pair of pressure plates 26 are locked to the outer surface of the support plate 2 by hooks 27 and are secured to the outer surface of the support plate by fixing members 29. Each pressure plate 26 passes through a corresponding hole 2*b* formed in the support plate 2 and extends to the interior of the cassette. A pressure member 30 is mounted on a free end of each pressure plate 26 via shaft 30*a*. A base end of the shaft 30*a* is supported by the support plate 2 for idle rotation and is held by a push nut 31 not detachable from the support plate. The pressure plates 26, pressure rollers 30 and the like constitute a pressurizing unit 32.

Also in this embodiment, the cassette 1 is mounted within a sheet feeding apparatus 10 similar to that of the first embodiment, and the sheet feeding apparatus 10 has the cam 15 (FIG. 2).

In this embodiment, the skew stack of the sheets S rested in the cassette 1 is corrected as follows. That is to say, when the cassette 1 in which the sheets S are stacked is inserted into the sheet feeding apparatus 10, the skew stack correcting members 20 are engaged by the cam 15 of the cassette guide 11 to be deployed into the cassette 1. The deployment of the skew stack correcting members 20, urges the pressure plates 26 inwardly to increase the deflection rate of those pressure plates, thus increasing the forces applied to the pressure members 30. As a result, the obliquely stacked sheets S are urged against the edge regulating member 4 (FIG. 1) by the greater urging forces of the pressure members 30, thus correcting the skew stack of the sheets S. Further, after the mounting of the cassette 1 is completed, since the biasing force of the biasing mechanism 25 against the pressurizing unit 32 is released, the pressurizing unit 32 urges the sheets S with the normal urging force.

According to this embodiment, with the arrangement as mentioned above, the following advantages can be obtained:

(1) Since the obliquely stacked sheets S are not subjected to the greater force at a single time, it is possible to correct the skew stack of the sheets S without applying the excessive force to the sheets S.

(2) Since the sheets S are urged at two different points at different times, the skew stack of the sheets S can be corrected more surely or reliably.

(3) By providing a plurality of pressure members 30 for urging the sheets S, it is also possible to urge only the sheets S disposed near the bottom of the sheet stack, which are the most difficult to correct in a skew stack.

Next, a third embodiment of the present invention will be explained with reference to FIG. 4.

Figure 4:
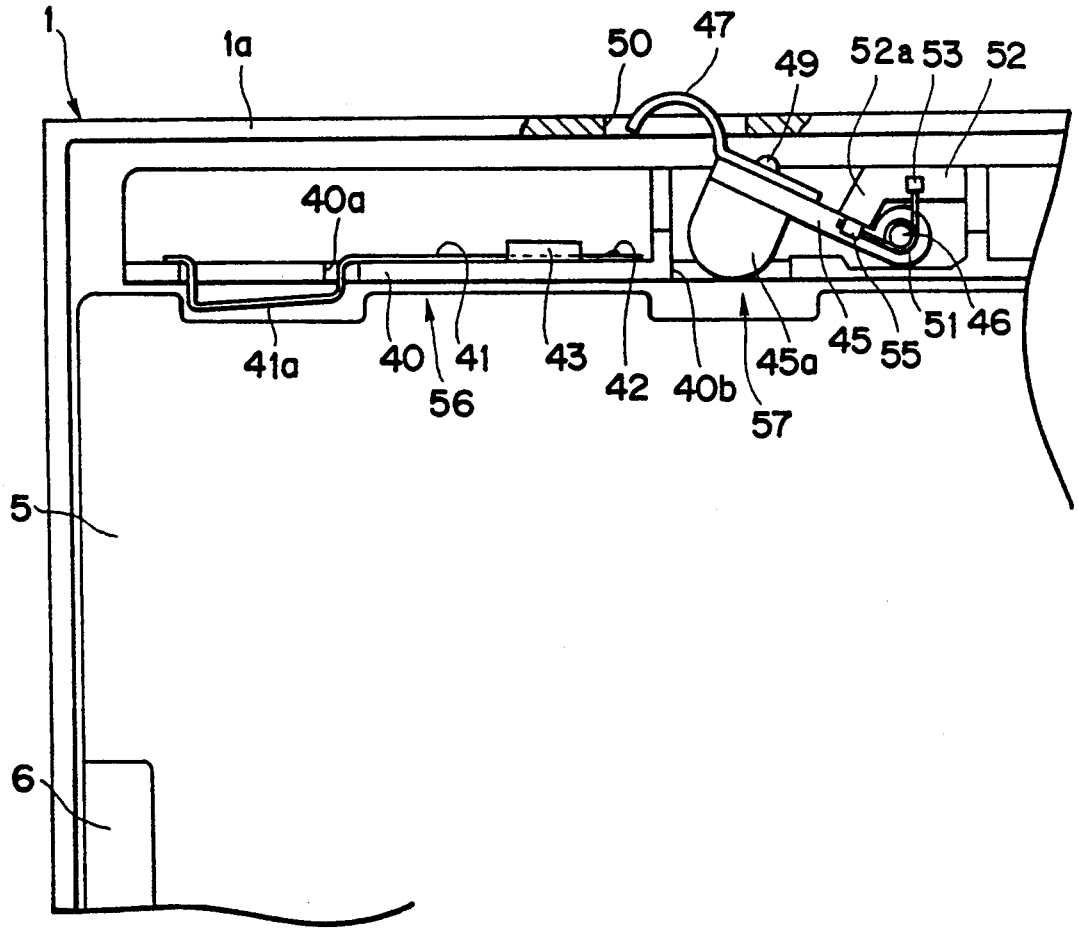
FIG. 4 is a partial plan view, in partial section, of a cassette according to a third embodiment of the present invention.

In FIG. 4, a base portion of a pressure plate 41 is locked to an outer surface of a support plate 40 by a hook 42 and is secured to the outer surface of the support plate by a fixing member 43. A convex pressure portion 41*a* formed on a free end portion of the pressure plate 41 passes through a hole 40*a* formed in the support plate 40 and extends to the interior of the cassette. The pressure plate 41 constitutes a first pressurizing unit 56.

A pressure arm 45 has a base portion pivotally mounted on the support plate 40 via a pivot pin 45 and a free end to an inner surface of which a pressure member 45*a* is secured. The pressure member 45*a* can protrude into the interior of the cassette through an opening 40*b* formed in the support plate 40. Further, a base portion of a leaf spring 47 is secured to an outer surface of the free end portion of the pressure arm 45 by screws 49, and a free end of the leaf spring 47 extends outwardly through an opening 50 formed in the side wall 1*a*. A torsion spring 51 arranged around the pivot pin 46 has one end locked by a hook 55 of the pressure arm 45, and the other end locked, via a hook 53, to an abutment member 52 secured to the support plate 40. Normally, the pressure arm 45 is abutted against a free end portion 52a of the abutment member 52 by a spring force of the torsion spring 51.

According to this embodiment, with the arrangement as mentioned above, the skew stack of the sheets S is corrected as follows.

First of all, when the cassette 1 in which the sheets S are stacked is inserted along the guide grooves 12 (FIG. 2) of the cassette guides 11, the leaf spring 47 is engaged by the cam 15, thus retracting the leaf spring 47. As a result, the pressure arm 45 and the pressure member 45a are rotated in an anti-clockwise direction in FIG. 4 to urge the obliquely stacked sheets S against the edge regulating member 4 (FIG. 1), thus correcting the skew stack of the sheets S.

According to this embodiment, with the arrangement as mentioned above, the following advantages, other than those obtainable by the first embodiment, can be obtained:

(1) This embodiment can be applied to a cassette containing large-sized sheets wherein a stronger force is required to correct the skew stack of the sheets S.

(2) Since the pressure plate 41 for providing the normal urging force is not abutted by other member or members, the support plate 40 is not damaged.

(3) Since the pressure plate 41 can only be used to prevent the skew-feed of the sheet, it is possible to set the normal urging force for urging the sheets S to a lower value, thus facilitating the replenishment of the sheets in the cassette.

Next, a fourth embodiment of the present invention will be explained with reference to FIG. 5.

Figure 5:
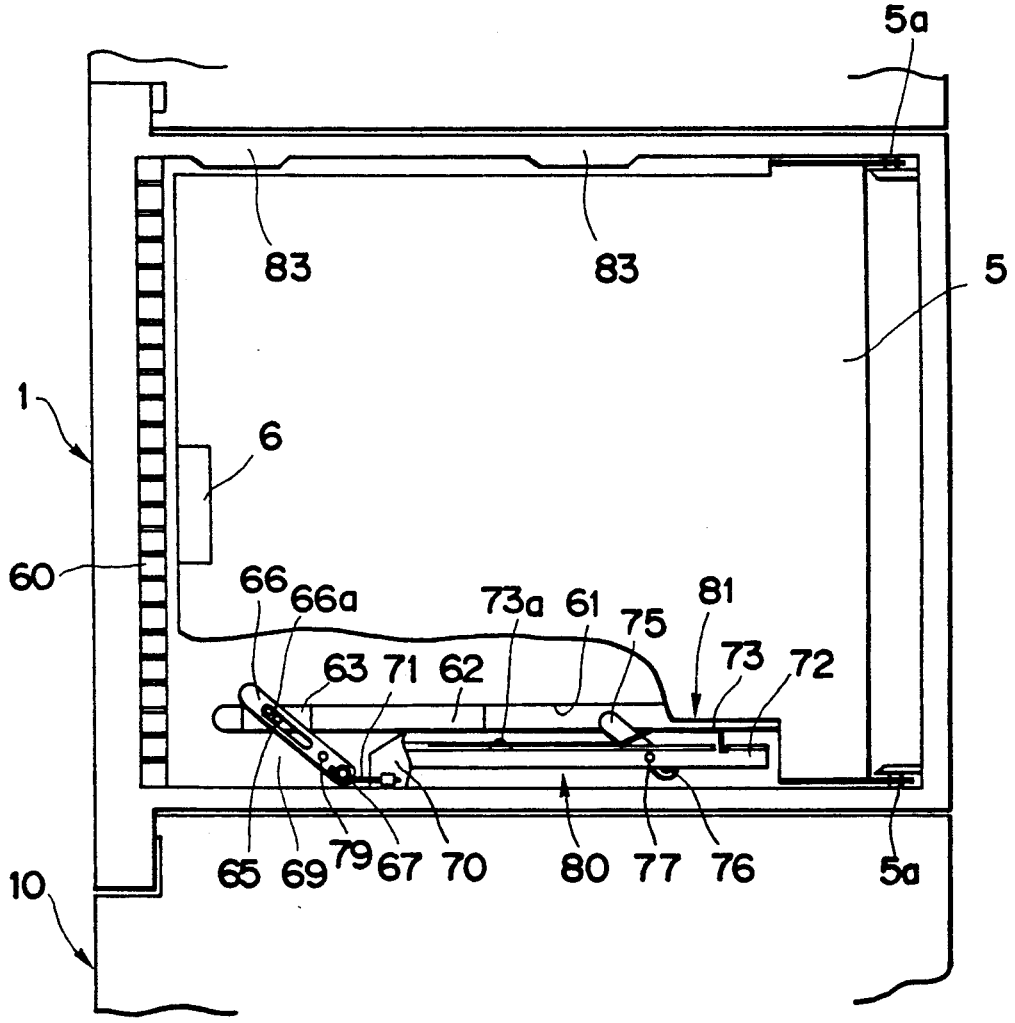
FIG. 5 is a plan view, in partial section, of a cassette according to a fourth embodiment of the present invention.

In FIG. 5, a cassette 1 is shown as being mounted within a sheet feeding apparatus 10 and is provided at its front portion with a sheet guide 60. An intermediate plate 5 on which the sheets S are stacked is pivotally mounted on the cassette 1 via pivot pins 5a.

The cassette 1 is further provided at its bottom with a slot 61 into which a boss 62 of the sheet feeding apparatus 10 is loosely fitted. A first link 66 is pivotally mounted at its base portion on an undersurface of the intermediate plate 5 via a pivot pin 67, and a slot 66a formed in the first link 66 loosely receives a pin 65 secured to a piston 63 which is loosely fitted into the slot 61 of the cassette. A torsion spring 71 arranged around the pivot pin 67 has one end locked to the first link 66 and the other end locked to a regulating member 70 so that the piston 63 is biased to be abutted against the boss 62 by a spring force of the torsion spring 71. Incidentally, regulating members 69, 70 provided on the cassette 1 limit or regulate a range of rotation of the first link 66.

Further, a second link 75 parallel with the first link 66 is pivotally mounted at its base portion on the undersurface of the intermediate plate 5 via a pivot pin 76, and a support plate 72 is pivotally mounted on the second link 75 via a pivot pin 77. A pressure plate 73 comprising a leaf spring and having a pair of pressure portions is secured to the support plate 72 by screws 73a. Further, the first link 66 is pivotally mounted, via a pin 79, on the other end (not shown) of the support plate 72. The first link 66, second link 75 and support plate 72 constitute a link mechanism 80.

Incidentally, when the cassette 1 is not mounted within the sheet feeding apparatus 10, since there is no boss 62 in the slot 61, the first link 66 is abutted against the regulating member 70 by the spring force of the torsion spring 71. Further, the support plate 72 and the pressure plate 73 are protruded from the intermediate plate 5 into the interior of the cassette 1, so that the sheets S in the cassette are pressurized by the pressure plate 73 with the normal urging force.

According to this embodiment, with the arrangement as mentioned above, the skew stack of the sheets S is corrected as follows.

First of all, when the cassette 1 is mounted within the sheet feeding apparatus 10, the boss 62 is inserted into the slot 61. In this condition, the cassette 1 is further inserted into the apparatus, the boss 62 is abutted against the piston 63, thus pushing the piston forwardly of the cassette 1 (left in FIG. 5). Consequently, the first link 66 is rotated from a position where it was abutted against the regulating member 70 to a position where it is abutted against the regulating member 69, and the second link 75 is also rotated in the same direction, with the result that the pressure plate 73 is firstly protruded toward the interior of the cassette 1 and then is retracted. In this way, the pressure plate 73 urges the sheets S obliquely stacked on the intermediate plate 5 against an edge regulating member 83 with the greater urging force applied temporarily, thus correcting the skew stack of the sheets S. On the other hand, when the cassette 1 is dismounted from the sheet feeding apparatus 10, the first link 66 is rotated in the clockwise direction (FIG. 5) by the spring force of the torsion spring 71 to abut against the regulating member 70, thus restoring the non-cassette mounting condition.

According to this embodiment, with the arrangement as mentioned above, the following advantages, other than those obtainable by the first embodiment, can be obtained:

(1) Since the pressure plate 73 is not abutted by other member or members when the pressure plate urges the sheets with the greater urging force, the pressure plate 73 is not damaged.

(2) Since there is no member protruding outwardly from the side walls of the cassette 1, this embodiment can be applied to a sheet feeding apparatus having narrow cassette containing space.

(3) It is possible to position the cassette 1 with respect to the sheet feeding apparatus and simultaneous correct the skew stack of the sheets S.

Incidentally, it should be understood that, even when the pressurizing unit and the biasing mechanism for performing the correction of the skew stack of the sheets are arranged on opposite sides of the cassette, the same advantages can be achieved.

As mentioned above, by providing the biasing means for temporarily urging the lateral edges of the sheets obliquely stacked in the cassette with the greater urging force by a temporary time period during the mounting of the cassette within the sheet feeding apparatus, it is possible to stably correct the skew stack of the sheets in the cassette, thus ensuring the proper image formation accuracy regardless of the operator's handling of the sheets.

Further, since the pressurizing unit for always urging the lateral edges of the sheets may only serve to regulate the left and right movement of the sheets during the insertion of the cassette, it is possible to make the elastic force of the pressure plate of the pressurizing unit weaker, with the result that the replenishment and removal of the sheets with respect to the cassette can be facilitated.

Figure 6:
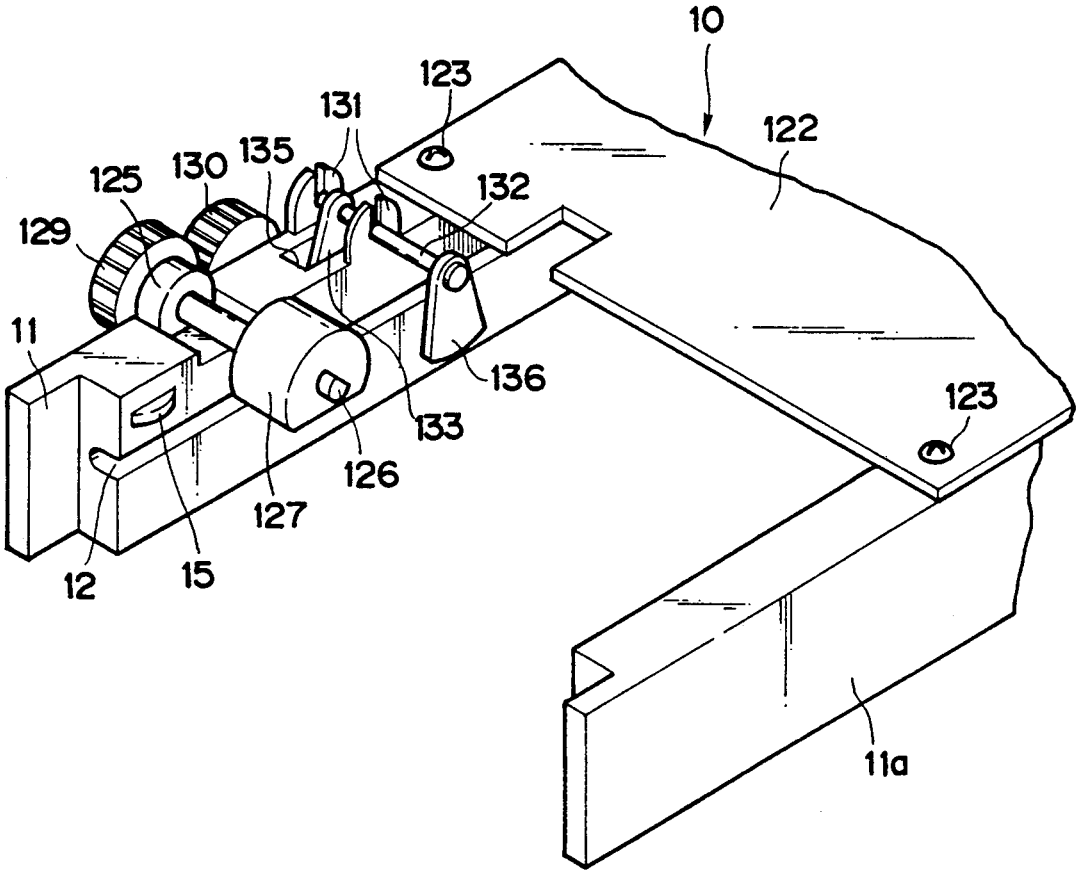
FIG. 6 is a perspective view of a sheet supply means according to an embodiment of the present invention.

FIG. 6 is a perspective view of a sheet feeding apparatus 10 of an image forming system within which a cassette 1 can be mounted. The apparatus 10 has a pair of cassette guides 11, 11*a* on which guide grooves 12 are formed, respectively, and a stay 122 secured to upper surfaces of the cassette guides by screws 123. A sheet supply roller shaft 126 is rotatably supported by a bearing 125 formed on the cassette guide 11. A semi-cylindrical sheet supply roller 127 is secured to an inner end of the shaft 126 and a sheet supply gear 129 is secured to an outer end of the shaft 126. The sheet supply gear 129 is meshed with a gear 130 in a gear train connected to a drive source (not shown).

Further, a sensor shaft 132 is rotatably supported by a pair of bearings 131 formed on the cassette guide 11, and a sensor flag 133 secured to the sensor shaft 132 passes through an opening 135 formed in the cassette guide 11 and serves to electrically detect the presence/absence of the sheet by turning ON or OFF a photointerrupter (not shown). Further, a sensor arm 136 secured to the other end of the sensor shaft 132 serves to detect the presence/absence of the sheet in the cassette 1.

Figure 7:
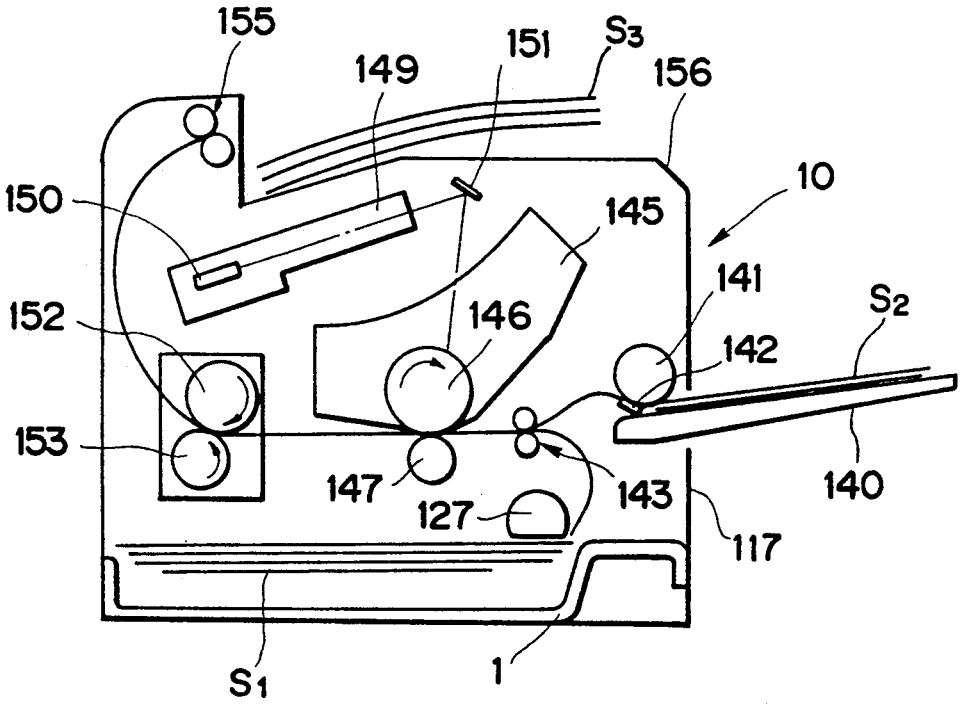
FIG. 7 is an elevational sectional view showing an example of an image forming system to which the present invention is applied.

FIG. 7 shows the construction of the image forming system.

In FIG. 7, at a lower portion of the image forming system 10, a cassette 1, in which sheets $S_1$ are stacked, a sheet supply roller 127 and the like are arranged. Further, a multi-tray 140 on which a small amount of sheets $S_2$ are stacked is also arranged on the image forming system 10. The sheets $S_2$ are separated and supplied one by one by a sheet supply roller 141 and a separating pad 142 to reach a pair of registration rollers 143. A process cartridge 145 includes a photosensitive drum 146, a developing device (not shown), a cleaner (not shown) and the like therein. A laser scanner 149 includes a laser light source (not shown), a polygonal mirror 150 and the like and serves to illuminate a laser beam on the photosensitive drum 146 via a mirror 151 for forming a latent image on the drum. The latent image is then developed by the developing device to form a toner image.

The toner image formed on the photosensitive drum 146 is transferred onto the sheet $S_1$ (or $S_2$) by a transfer roller 147. Then, the sheet is sent to a fixing station including a fixing roller 152 and a pressure roller 153, where the toner image is permanently fixed to the sheet. Thereafter, the sheet $S_1$ (or $S_2$) is ejected onto an ejection tray 156 by ejector roller 155.

When the image formation start signal is emitted, the sheet supply gear 129 (FIG. 6) is rotated via the gear 130 from the drive source, thus integrally rotating the sheet supply roller 127. Only the uppermost sheet $S_1$ is picked up from the sheet stack by the rotation of the sheet supply roller 127 and the separating action of the separating claws and is sent to the paired registration rollers 143 shown in FIG. 7. The sheet $S_1$ on which the toner image was transferred from the photosensitive drum 146 is sent to the fixing station comprising the fixing roller 152 and the pressure roller 153, where the toner image is fixed to the sheet. Then, the sheet is ejected onto the ejection tray 156 by means of the ejector rollers 155.

Figure 8:
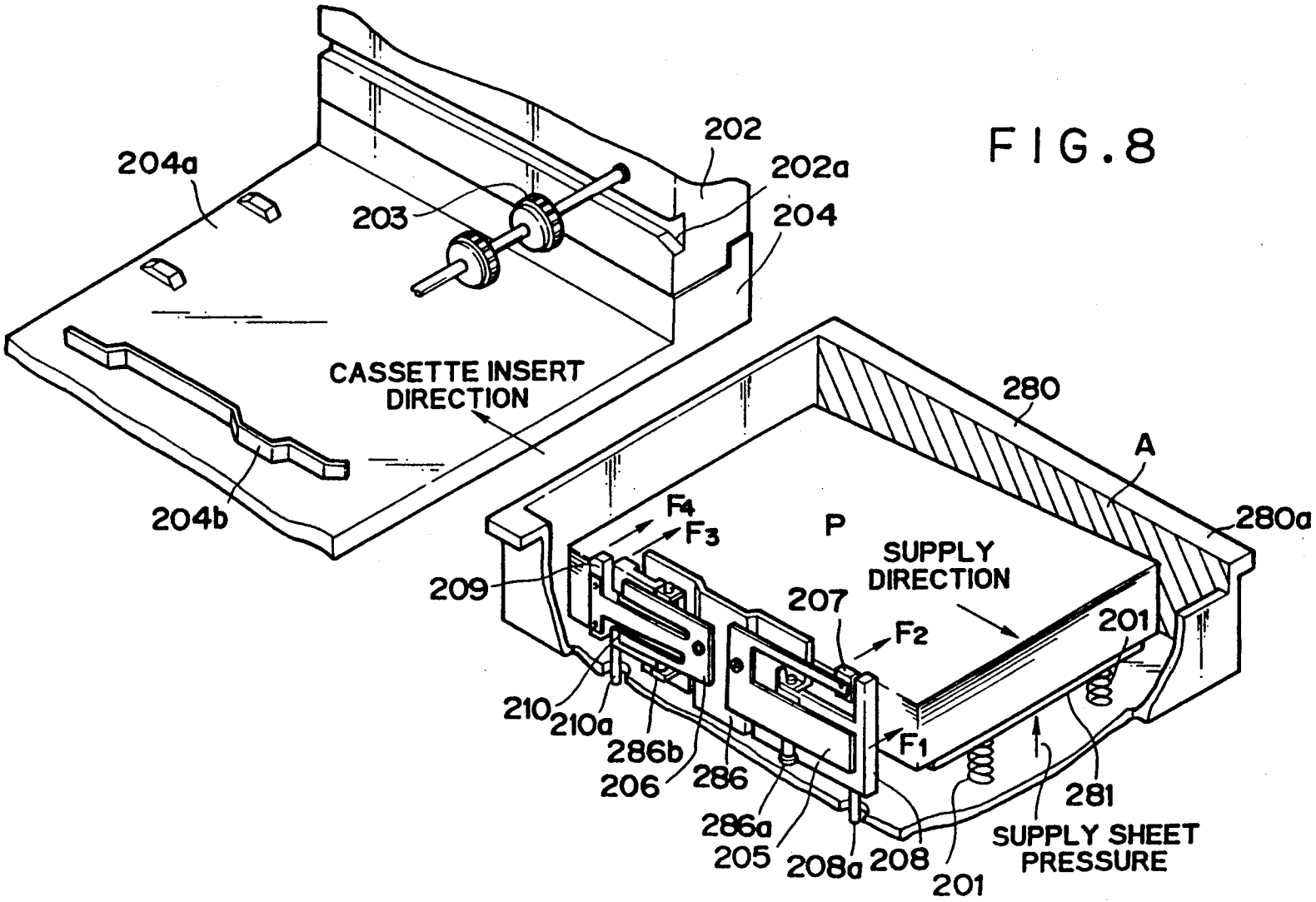
FIG. 8 is a perspective view showing a fifth embodiment of the present invention.
Figure 9:
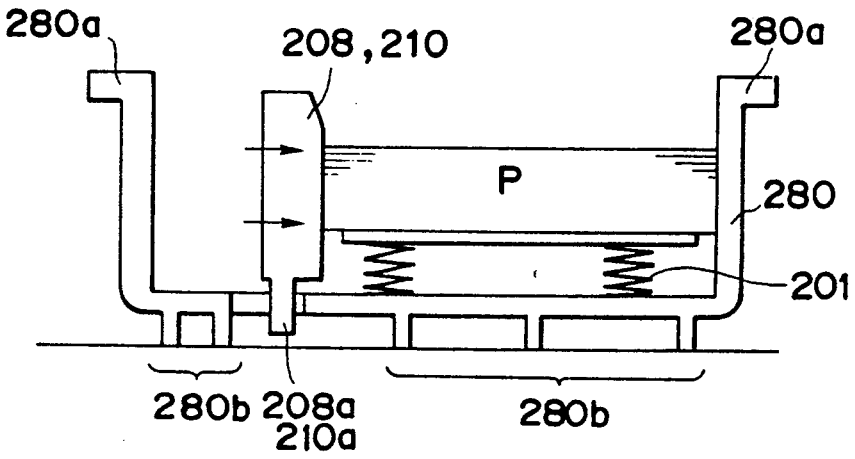
FIG. 9 is a sectional end view showing a condition that a cassette is mounted within a sheet feeding apparatus, according to the fifth embodiment.

FIGS. 8 through 10 show a fifth embodiment of the present invention. In this embodiment, a sheet cassette 280 includes therein a sheet stacking plate 281 on which sheets P are to be stacked. The sheet stacking plate 281 is pivotable around its rear end (regarding a sheet feeding direction) and has a front end biased upwardly by springs 201 so that the sheets P stacked on the plate can be urged against sheet supply rollers 203 of a sheet feeding apparatus 202.

The sheet cassette 280 is positioned in an up-and-down direction by inserting side flange 280*a* of the cassette into corresponding grooved rails 202*a* formed on both side of the apparatus 202. In the illustrated embodiment, so long as the sheet feeding apparatus 202 has no additional or auxiliary member, it can receive a sheet cassette (not shown) having sheet capacity of 250 sheets. However, when a cassette extender (additional member) 204 capable of expanding a space below the sheet supply rollers 203 is attached to the bottom of the sheet feeding apparatus 202, the apparatus can receive a sheet cassette having sheet capacity of 500 sheets (the illustrated sheet cassette 280). The cassette extender 204 can expand the space below the sheet supply rollers and has a stay portion 204*a* for interconnecting both legs of the apparatus 202 to prevent the bending and tilting of the legs of the apparatus 202.

The sheet cassette 280 has a reference surface A formed on a side wall thereof (facing a direction transverse to the sheet supply direction). By properly abutting the lateral edges of the sheets P against the reference surface A, the sheets P can be positioned with respect to the sheet feeding apparatus so that the sheets are properly set in the image forming system for the image formation. In order to urge the lateral edges of the sheets against the reference surface A, a front leaf spring 205 (at an downstream side in the sheet supply direction) and a rear leaf spring 206 (at an upstream side in the sheet supply direction) are secured to an opposite side plate 286*b* by screws. A molded member 207 for urging the lateral edges of the sheets P with an urging force of $F_2$ at the leading end portions of the sheets in the sheet supply direction and for providing the smooth contact between the molded member and the sheets and for preventing the damage of the sheets, is secured to the front leaf spring 205 by the heat caulking technique.

Further, in the vicinity of the molded member 207, a rockable member 208 for urging the lateral edges of the sheets P with an urging force of $F_1$ stronger than the force $F_2$ of the front leaf spring is mounted on the side plate 286 for pivotal movement about a pivot shaft 286*a*. The rockable member 208 is provided at its bottom with a cam follower 208*a* passing through a hole formed in the bottom of the cassette and protruding downwardly from the cassette. However, since the height of ribs 280*b* formed on the undersurface of the bottom of the cassette 280 is greater than the protruded distance of the cam follower 208*a*, even when the cassette is rested on a flat surface such as a desk, the cam follower 208*a* is not damaged. Similarly a molded member 209 for contacting with the lateral edges of the sheets and for urging the sheets with an urging force $F_4$ is secured to the rear leaf spring 206 by the heat caulking technique. In the vicinity of the molded member 209, a rockable member 210 for urging the lateral edges of the sheets P with an urging force of $F_3$ stronger than the force $F_4$ of the rear leaf spring is mounted on the side plate 286 for pivotal movement about a pivot shaft 286*b*. The rockable member 210 is also provided at its bottom with a cam follower 210*a* having the same construction as that of the cam follower 208*a*.

Figure 10A:
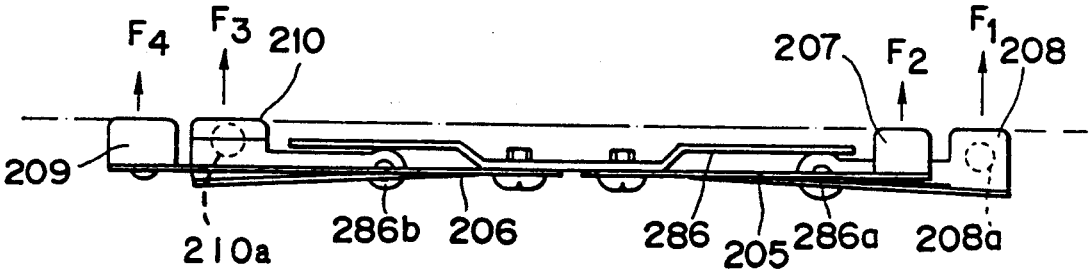
FIG. 10A is a plan view of an urging means before the insertion of the cassette into the sheet feeding apparatus is completed, according to the fifth embodiment.
Figure 10B:
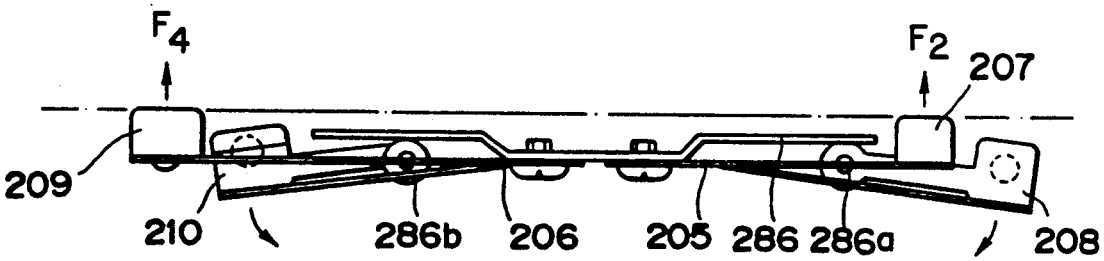
FIG. 10B is a plan view of the urging means after the insertion of the cassette into the sheet feeding apparatus is completed, according to the fifth embodiment.

When the sheets P were loaded in the cassette 280 when detached from the image forming system, as shown in FIG. 10A, since the sheets are urged from their lateral edges against the reference surface A with the combined forces of $(F_1+F_2+F_2+F_4)$ (about 200–300 grams), even when the full capacity of sheets are loaded in the 500 sheet cassette, the skew stack of the sheets can, be properly corrected. By inserting the cassette 280 into the sheet feeding apparatus 202, as shown in FIG. 10B, the cam followers 208*a*, 210*a* of the rockable members 208, 210 are shifted away from the sheets P by means of a cam portion 204*b* formed on the cassette extender 204, thus releasing the forces $F_1$ and $F_3$, with the result that, since only the forces $F_2$ and $F_4$ act on the lateral edges of the sheets, the sheet supply pressure can be reduced greatly.

In the illustrated embodiment, while an example that the side urging force is controlled by the cam portion 204*b* of the cassette extender 204 was explained, the present invention is not limited to this example, but, such control means (like the cam portion) may be provided in the sheet feeding apparatus.

Incidentally, in the illustrated embodiment, by utilizing the cassette extender 204, the sheet feeding apparatus or the image forming system can receive both the cassette having the capacity of 250 sheets (without the cassette extender) and the cassette having the sheet capacity of 500 sheets (with the cassette extender).

Further, it should be noted that the present invention can be applied to any apparatus, as well as the apparatus wherein the cassette is inserted in a direction opposite to the sheet supply direction as in the illustrated embodiment.

Figure 11A:
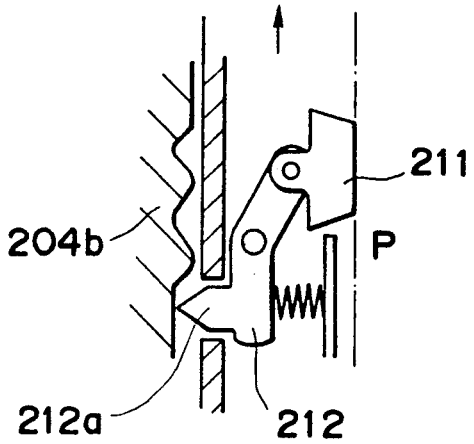
FIG. 11A is a plan view showing another example of an urging means before the insertion of the cassette into the sheet feeding apparatus is completed, according to the fifth embodiment.
Figure 11B:
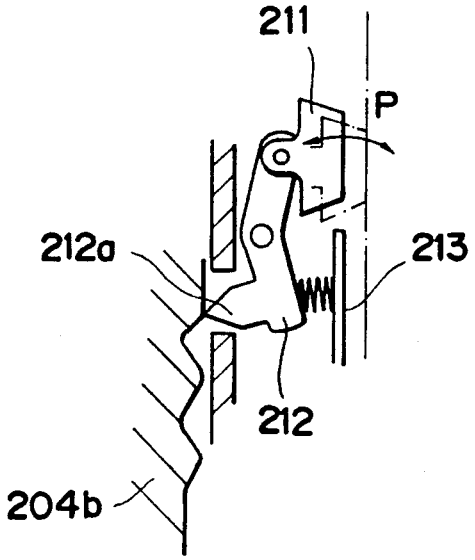
FIG. 11B is a plan view of the urging means after the insertion of the cassette into the sheet feeding apparatus is completed, according to the embodiment of FIG. 11A.
Figure 12A:
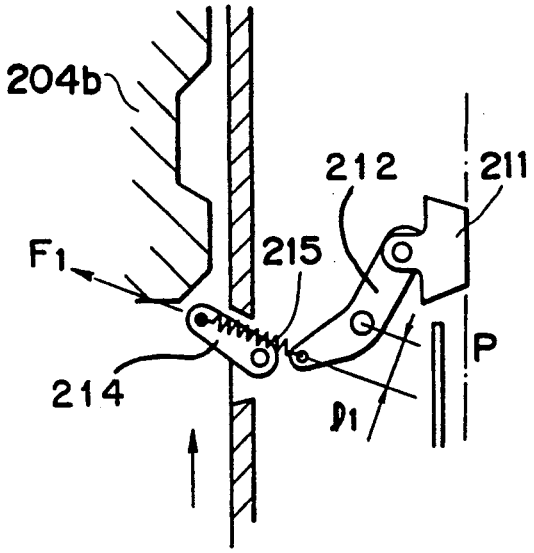
FIG. 12A is a plan view showing a further example of an urging means before the insertion of the cassette into the sheet feeding apparatus is completed, according to the fifth embodiment.
Figure 12B:
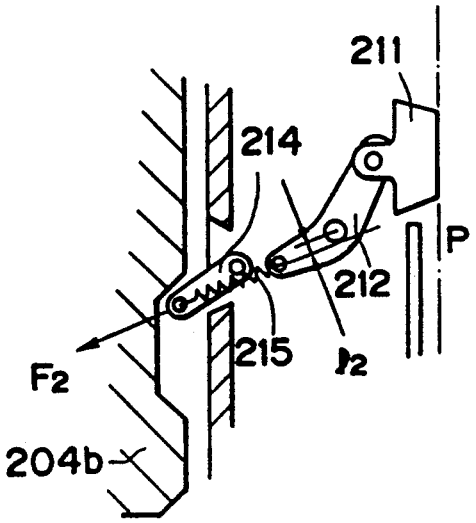
FIG. 12B is a plan view of the urging means after the insertion of the cassette into the sheet feeding apparatus is completed, according to the embodiment of FIG. 12A.
Figure 13A:
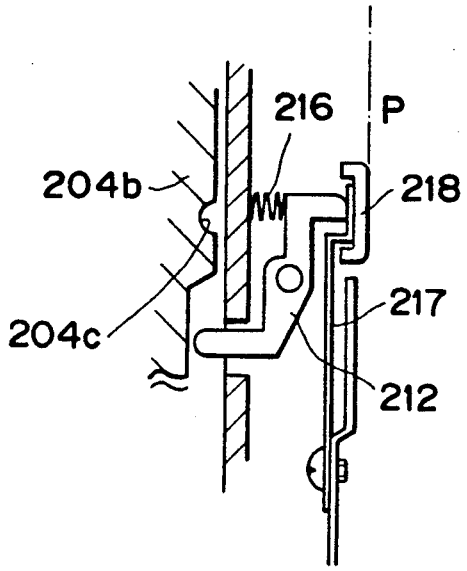
FIG. 13A is a plan view showing a still further example of an urging means before the insertion of the cassette into the sheet feeding apparatus is completed, according to the fifth embodiment.
Figure 13B:
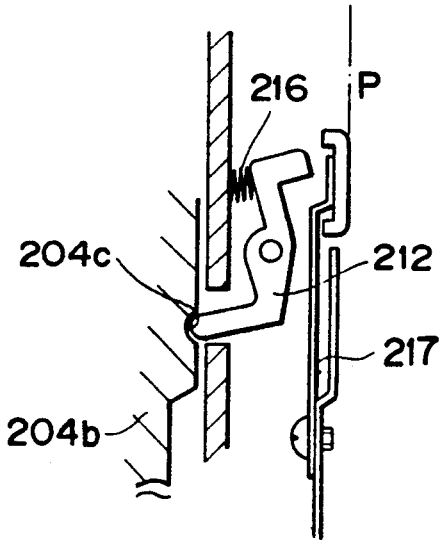
FIG. 13B is a plan view of the urging means after the insertion of the cassette into the sheet feeding apparatus is completed, according to the embodiment of FIG. 13A.
Figure 14:
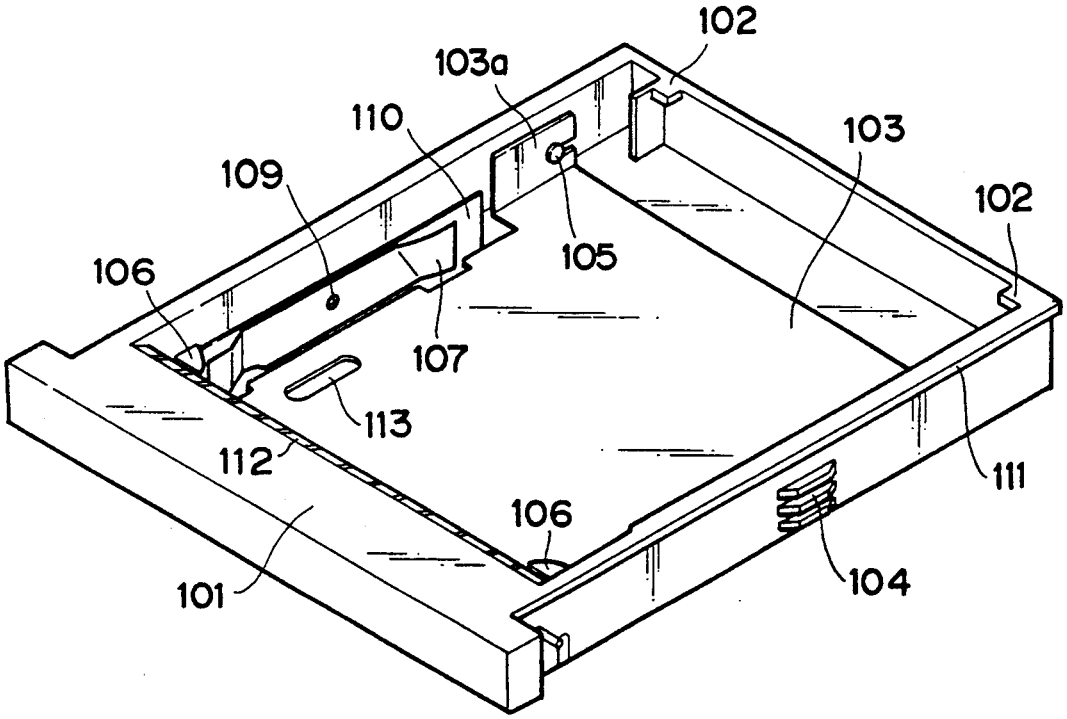
FIG. 14 PRIOR ART
FIG. 14 is a perspective view of a conventional cassette showing an example of an urging means.
Figure 15:
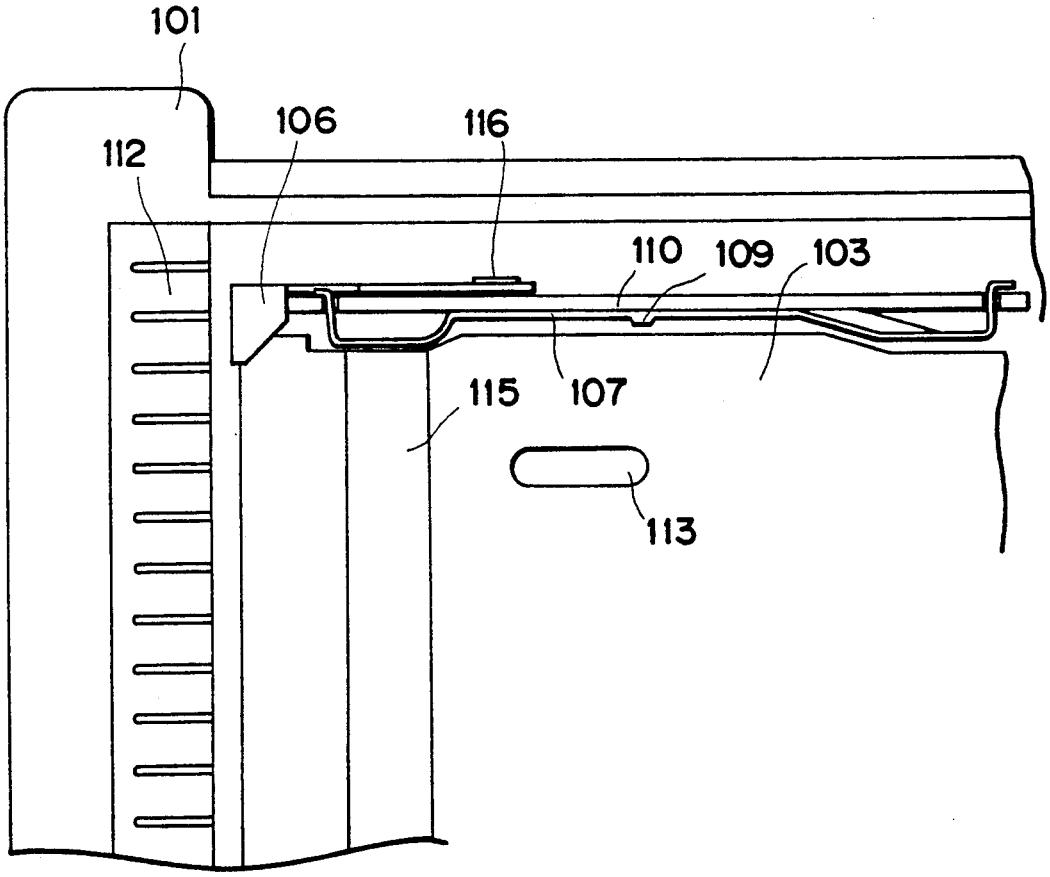
FIG. 15 PRIOR ART
FIG. 15 is a partial plan view of the urging means of FIG. 14.

FIGS. 11 through 13 show further embodiments of the present invention. These Figures only illustrate urging mechanisms for urging the sheets. Incidentally, FIGS. 11A, 12A and 13A show a condition before the insertion of the cassette into the sheet feeding apparatus is finished whereas FIGS. 11B, 12B and 13B show a condition after the cassette has been inserted into the sheet feeding apparatus.

In an embodiment sheet in FIGS. 11A and 11B, a cam portion 204*b* has a plurality of peaks and valleys. Thus, as the cassette is being inserted, a rockable member 211 is repeatedly deployed and retracted by means of a rocker arm 212 having a cam follower 212*a* to repeat increase and decrease the side urging force of the rockable member 211, thus abutting the sheets P against the reference surface A without fail. When the insertion of the cassette is completed, the rockable member 211 is spaced apart from the sheets P or the urging force of the rockable member against the sheets is reduced, thus preventing the bad influence upon the sheet supply ability. Further, when the insertion of the cassette is completed, since the rockable member is not subjected to any external force, the urging force of the rockable member may be set to have a value merely to prevent the rotation of the sheets due to the action of the sheet supply rollers. Accordingly, since the normal urging force of the rockable member can be reduced, the sheet supply is not badly influenced by the urging force of the rockable member.

In an embodiment shown in FIGS. 12A and 12B, a toggle mechanism is used. That is to say, although the same tension spring 215 and rockable member 211 are utilized before and after the cassette is mounted within the sheet feeding apparatus, since a toggle arm 214 is rocked or pivoted by the peak of the cam portion 204*b* to change the acting direction of the tension spring 215, a torque acting on the rocker arm 212 is changed, thus varying the side urging force against the sheets P. In this case, since the same portion of the sheets is urged and a single mechanism is required, it is possible to make the apparatus more simple and cheap. Incidentally, the relation between the forces is set as $F_1 \times l_1 > F_2 \times l_2$.

In an embodiment shown in FIGS. 13A and 13B, the sheets P are urged by a member 218 biased by both a spring 216 and a leaf spring 217 while the cassette is being inserted, and, after the insertion of the cassette is completed, only the force of the spring 216 is released by the cam portion 204*b*, thus reducing the urging force during the sheet supply. Also in this case, the same portion of the sheets can be urged. Further, in this embodiment, by providing a recess 204*c* in the cam portion 204*b*, the cassette can be locked in position.

Incidentally, while the cassette was explained, the present invention is not limited to the cassette but may be applied to a paper deck and the like.

As mentioned above, since the sheet stacking portion of the sheet feeding apparatus can selectively occupy a first position where the sheet can be supplied and a second position where the sheets can be replenished, and the urging force for urging the lateral edges of the sheets can be varied in accordance with the movement of the sheet stacking portion, the sheets can be correctly and properly abutted against the reference surface, thus permitting the high accurate sheet supply and preventing the poor sheet supply.

Incidentally, in the above embodiments, while the urging force of the urging means was adjusted in response to the insertion and retraction of the cassette, the present invention can be applied to a sheet supporting means comprising a deck removably mountable within the sheet feeding apparatus or the image forming system.

What is claimed is:

1. A sheet feeding apparatus comprising:

sheet supporting means removably insertable into said sheet feeding apparatus for supporting sheets;

regulating means provided on said sheet supporting means to regulate and position lateral edges of the sheets supported in said sheet supporting means;

urging means for urging at a predetermined urging force the sheets stacked in said sheet supporting means against said regulating means; and urging force adjusting means for adjusting said urging means so that a magnitude of the urging force is increased during insertion of said sheet supporting means into said sheet feeding apparatus.

2. A sheet feeding apparatus according to claim 1, further comprising sheet supply means for feeding out the sheets stacked in said sheet supporting means, and said regulating means positions the sheets by abutting against the lateral edges of the sheets parallel to a sheet supply direction.

3. A sheet feeding apparatus according to claim 1, wherein said urging means comprises a leaf spring for urging the sheets against said regulating means, and said urging force adjusting means deforms said leaf spring to increase the urging force acting on the sheets.

4. A sheet feeding apparatus according to claim 3, wherein said urging force adjusting means comprises a pressure member for urging said leaf spring toward said regulating means, and cam means provided on said sheet feeding apparatus to shift said pressure member means during insertion of said sheet supporting means into said sheet feeding apparatus.

5. A sheet feeding apparatus according to claim 4, wherein said pressure member means is biased away from said leaf spring means by biasing means.

6. A sheet feeding apparatus according to claim 1, wherein said urging means comprises a pressure member for always urging the sheets against said regulating means, and an auxiliary pressure member for temporarily urging the sheets against said regulating means in response to the insertion movement of said sheet supporting means into said sheet feeding apparatus.

7. A sheet feeding apparatus according to claim 1, wherein said urging means comprises a pressure member contacted with the sheets and a link mechanism for shifting said pressure member means between an urging position and a waiting position spaced apart from said urging position.

8. A sheet feeding apparatus according to claim 7, wherein said urging force adjusting means comprises a cam member provided on said sheet feeding apparatus to shift said link mechanism during insertion of said sheet supporting means into said sheet feeding apparatus.

9. A sheet feeding apparatus according to claim 1, wherein said sheet supporting means comprises a cassette removably mountable within said sheet feeding apparatus and in which the sheets can be stacked.

10. A sheet feeding apparatus according to claim 1, wherein said sheet supporting means comprises a deck insertable and retractable with respect to said sheet feeding apparatus and on which the sheets can be stacked.

11. An image forming apparatus comprising:

sheet supporting means removably insertable into said image forming apparatus for supporting sheets;

regulating means provided on said sheet supporting means to regulate and position lateral edges of the sheets supported in said sheet supporting means;

urging means for urging with a predetermined force the sheets stacked in said sheet supporting means against said regulating means;

urging force adjusting means for adjusting said urging means so that a magnitude of said urging force is increased during insertion of said sheet supporting means into said image forming apparatus;

sheet supply means for supplying the sheets stacked in said sheet supporting means; and image forming means for forming an image on the sheet supplied by said sheet supply means.

12. An image forming apparatus according to claim 11, wherein said regulating means positions the sheets by abutting against the lateral edges of the sheets parallel to a sheet supply direction.

13. An image forming apparatus according to claim 12, wherein a direction that said sheet supporting means is inserted into said image forming system is opposite to a direction that the sheet is fed out from said sheet supporting means by said sheet supply means.

14. An image forming apparatus according to claim 11, wherein said urging means comprises a leaf spring for urging the sheets against said regulating means, and said urging force adjusting means deforms said leaf spring to increase the urging force acting on the sheets.

15. An image forming apparatus according to claim 11, wherein said urging means comprises a pressure member for always urging the sheets against said regulating means, and an auxiliary pressure member for temporarily urging the sheets against said regulating means in response to the insertion movement of said sheet supporting means into said image forming system.

16. An image forming apparatus according to claim 11, wherein said urging means comprises a pressure member contacted with the sheets, and a link mechanism for shifting said pressure member means between an urging position and a waiting position spaced apart from said urging position, and said urging force adjusting means comprises a cam member provided on said image forming system and adapted to shift said link mechanism when said sheet supporting means is inserted into said image forming system.

17. A sheet feeding apparatus comprising:

sheet supporting means removably insertable into said sheet feeding apparatus for supporting sheets;

regulating means provided on said sheet supporting means to regulate and position lateral edges of the sheets supported in said sheet supporting means;

a plurality of urging means arranged in a sheet feeding direction for urging the sheets supported in said sheet supporting means against said regulating means by respective predetermined forces; and releasing means for selectively releasing an urging force of at least one of said plurality of urging means so that a magnitude of urging by said plurality of urging means is reduced when said sheet supporting means is inserted into said sheet feeding apparatus.

18. A sheet feeding apparatus according to claim 17, wherein said urging means is pivotable between an urging position for urging the sheets and a releasing position spaced apart from said urging position, and said releasing means selectively releases the urging force by said at least one of said plurality of urging means from said urging position to said releasing position.

19. A sheet feeding apparatus according to claim 18, wherein said releasing means comprises a pin provided on said urging means, and a cam means provided on said sheet feeding apparatus and adapted to displace said pin means to shift said urging means to said releasing position.

20. An image forming apparatus comprising:

sheet supporting means removably insertable into said image forming apparatus to support sheets;

regulating means provided on said sheet supporting means to regulate and position lateral edges of the sheets supported in said sheet supporting means;

a plurality of urging means arranged in a sheet feeding direction for urging the sheets supported in said sheet supporting means against said regulating means by respective predetermined urging forces; and releasing means for selectively releasing an urging force of at least one of said plurality of urging means so that a magnitude of urging by said plurality of urging means is reduced when said sheet supporting means is inserted into said image forming apparatus;

sheet supply means for supplying the sheets supported in said sheet supporting means; and image forming means for forming an image on the sheet supplied by said sheet supply means.

21. A sheet feeding apparatus, comprising:

sheet supporting means removably insertable into said sheet feeding apparatus and for supporting sheets;

regulating means provided on said sheet supporting means to regulate and position lateral edges of the sheets supported in said sheet supporting means;

urging means for urging the sheets supported in said sheet supporting means against said regulating means by a predetermined force; and urging force adjusting means for adjusting said urging means so that a magnitude of the urging force is reduced in response to the insertion of said sheet supporting means into said sheet feeding apparatus.

22. A sheet feeding apparatus according to claim 21, wherein said urging means comprises a plurality of urging members and said urging force adjusting means selectively releases the urging force of at least one of said plurality of urging members.

23. A sheet feeding apparatus according to claim 22, wherein said urging member is mounted for rocking movement, and said urging force adjusting means includes a cam so that the urging force is reduced as said sheet supporting means is inserted into the sheet feeding apparatus by selective rocking of said urging members from an urging position to a releasing position.

24. An image forming apparatus, comprising:

sheet supporting means removably insertable into said image forming apparatus and for supporting sheets;

regulating means provided on said sheet supporting means to regulate and position lateral edges of the sheets supported in said sheet supporting means;

urging means for urging the sheets supported in said sheet supporting means against said regulating means by a predetermined force;

urging force adjusting means for adjusting said urging means so that a magnitude of the urging force is reduced in response to insertion of said sheet supporting means into said image forming apparatus;

sheet supplying means for supplying the sheets stacked in said sheet supporting means; and image forming means for forming an image on the sheet supplied by said sheet supplying means.

25. A sheet feeding apparatus, comprising:

sheet supporting means removably insertable into said sheet feeding apparatus and for supporting sheets;

regulating means provided on said sheet supporting means to regulate and a position lateral edges of the sheets supported in said sheet supporting means;

a plurality of urging members arranged in the sheet feeding direction for urging the sheets supported in said sheet supporting means against said regulating means by respective predetermined urging forces; and releasing means for selectively releasing the urging force of at least one of said plurality of urging members in response to the insertion of said sheet supporting means into said sheet feeding apparatus, wherein the urging force to be released by said releasing means is set larger, while the urging force not to be released is set smaller.

26. A sheet feeding apparatus according to claim 25, wherein said urging member whose urging force is released urges the whole sheets, while said urging member whose urging force is not released urges a side of the supported sheets to be fed out.

27. An image forming apparatus, comprising:

sheet supporting means removably insertable into said image forming apparatus for supporting sheets;

regulating means provided on said sheet supporting means to regulate and position lateral edges of the sheets supported in said sheet supporting means;

plurality of urging members arranged in the sheet feeding direction for urging the sheets supported in said sheet supporting means against said regulating means by respective predetermined urging forces;

releasing means for selectively releasing the urging force of at least one of said plurality of urging members in response to the insertion of said sheet supporting means into said image forming apparatus, wherein the urging force to be released by said releasing means is set larger, while the urging force not to be released is set smaller;

sheet supply means for supplying the sheets supported in said sheet supporting means; and image forming means for forming an image on the sheet supplied by said sheet supplying means.

* * * * *

UNITED STATES PATENT AND TRADEMARK OFFICE

CERTIFICATE OF CORRECTION

PATENT NO. : 5,292,116
DATED : March 8, 1994
INVENTOR(S) : RYUKICHI INOUE, ET AL.

It is certified that error appears in the above-indentified patent and that said Letters Patent is hereby corrected as shown below:

Column 4,
Line 55, "biasing,; the" should read --biasing the--.

Column 14,
Line 42, "means" (first occurrence) should be deleted.

Column 16,
Line 5, "a" should be deleted.

Signed and Sealed this

Sixth Day of September, 1994

Bruce Lehman

*Attest:*

BRUCE LEHMAN

*Attesting Officer*

*Commissioner of Patents and Trademarks*